US005826721A

United States Patent [19]

Fujimoto et al.

[11] Patent Number: 5,826,721

[45] Date of Patent: Oct. 27, 1998

[54] ROLLED ARTICLE STORING AND TRANSPORTING CONTAINER

[75] Inventors: Kazuo Fujimoto, Tokuyama; Takahiko Koike, Tokyo, both of Japan

[73] Assignee: Zeon Kasei Co., Ltd., Tokyo, Japan

[21] Appl. No.: 861,789

[22] Filed: May 22, 1997

[30] Foreign Application Priority Data

May 24, 1996 [JP] Japan ..... 8-151863

[51] Int. Cl.[6] ..... B65D 85/66; B65D 19/00

[52] U.S. Cl. ..... 206/389; 220/1.5; 220/4.28

[58] Field of Search ..... 206/389, 391, 206/393, 397, 394, 415, 416, 600, 386; 220/4.28, 4.33, 4.34, 1.5

[56] References Cited

U.S. PATENT DOCUMENTS

| | | | |
|---|---|---|---|
| 4,151,914 | 5/1979 | Blatt | 206/386 |
| 4,445,614 | 5/1984 | Mitsumori et al. | 206/600 |
| 4,914,874 | 4/1990 | Graham, Jr. | 220/1.5 |
| 5,261,550 | 11/1993 | Karpisek | 220/4.33 |
| 5,269,414 | 12/1993 | D'Hollander | 206/600 |
| 5,415,486 | 5/1995 | Wouters et al. | 206/393 |
| 5,556,242 | 9/1996 | Kuan | 220/4.33 |
| 5,558,241 | 9/1996 | Huffstutler, Jr. et al. | 220/6 |
| 5,601,202 | 2/1997 | Meacham et al. | 220/6 |
| 5,722,551 | 3/1998 | Cocciemiglio, Jr. | 220/4.33 |

*Primary Examiner*—Paul T. Sewell
*Assistant Examiner*—Anthony Stashick
*Attorney, Agent, or Firm*—Armstrong, Westerman, Hattori, McLeland & Naughton

[57] ABSTRACT

A foldable container for storing and transporting rolled articles wound on a spool or a support tube, comprising a top cover, a bottom panel fixed to the bottom frame, front and rear partition panels, and left and right panels. The front and rear panels are each divided into upper and lower parts along division lines, and formed therein with support holes aligned with the division lines and opposed between the front and rear partition panels. The two halves of each of the support holes are covered at their inner peripheries with elastic protectors, and opposite end parts of the support tubes are received in the support holes so as to suspend the rolled articles between the partition panels. Thereby it is possible to surely store the rolled articles with less time and labor, and to reduce consumption of packing material to a minimum value with no damage thereto being caused even though primary packing is eliminated.

7 Claims, 2 Drawing Sheets

ROLLED ARTICLE STORING AND TRANSPORTING CONTAINER

BACKGROUND OF THE INVENTION

1. Field of the Invention

The present invention relates to a container for storing and transporting rolled articles in which a long web-like material such as a film, paper or fabric is wound on a spool, a bobbin or the like.

2. Description of Related Art

Conventionally, upon transportation of rolled articles each composed of a long web-like material such as a film, paper or fabric which is wound on a spool, a bobbin or the like, the rolled articles are individually packed with sheets at a primary packing stage, and then, they are bundled into several groups each of which is stored in a transporting container such as a corrugated card board container, and is then transported.

Since the rolled articles have to be individually packed with sheets, huge time and labor have been required, and further, since large quantity of packing materials have been consumed, a high packing cost has been required, and further, a large quantity of waste materials is also unavoidable due to consumption of a large quantity of packing materials. On the contrary, if the rolled articles would be packed in a single container by a large number without packing, the rolled articles would chafe against one another so as to raise various problems including a problem of damage to the rolled articles.

The applicant has studied the above-mentioned problems and had such an idea that rolled articles which are suspended in a packing container can prevent the outer surfaces of the rolled articles from being happened to be made into contact with one another or with the inner surface of the container.

SUMMARY OF THE INVENTION

The present invention is devised in order to eliminate the above-mentioned problems, and accordingly, an object of the present invention is to provide measures for packing rolled articles, which can pack rolled articles with less time and labor, and which can reduce consumption of packing materials so as to reduce the quantity of waste to a minimum value, and further, which can prevent damage to the rolled articles even though the above-mentioned primary packing stage at which the rolled articles are individually packed, is eliminated.

To the end, according to the present invention, there is provided a foldable container for storing and transporting rolled articles each composed of a long web-like material wound on a spool serving as a support tube, comprising a removable top cover, a bottom frame adapted to be fixed to a pallet, a bottom panel removably set on the bottom frame, front and rear partition panels removably set upright on the bottom panel in the bottom frame, and left and right side panels removably set upright on the bottom panel in the bottom frame so as to define a space in which the rolled articles are stored, in cooperation with the front and rear partition panels, the top cover and the bottom panels, wherein each of the partition panels are divided along division lines into a plurality of parts, each of the partition panels being formed therein with a required number of support holes on the division lines at positions which are opposed to those of the support holes formed in the front and rear partition panels so that the support holes are divided into upper and lower halves by the division lines, the upper and lower halves of each of the support holes having upper and lower inner peripheral parts which are covered thereover with elastic material protecting members, the support tube having opposite end parts which are received by the support holes so that the rolled article can be suspended and supported between the partition panels. It is noted that the rolled article and the support tube or the spool are not essential in the present invention.

In the container for storing and transporting rolled articles, according to the present invention, composed of the top cover, the bottom panel set in the bottom frame mounted on the pallet, and the side panels and the partition panels arranged upright at the four sides of the bottom frame so as to form a box-like container, the number of the support holes formed in each of the partition panels, for receiving the support tubes of the rolled articles corresponds to a maximum number of rolled articles to be stored in the container, and the distance between the partition panels is more or less shorter than the length of the support tube. The container body is mainly made of plywood, the components thereof such as the top cover, the bottom panel, the side panels and the partition panels are separatable from one another, and accordingly, the container body may be folded and received within the bottom frame which are made of wood, resin or metal. The support tube is preferably made of metal in view of a strength required therefor, and may be either solid or hollow. The web-like article may be directly wound on the support tube, or may be wound at first on a hollow spool and then the support tube may be inserted into the hollow spool.

In the above-mentioned container, each of the front and rear partition panels which are supported by the left and right side panels and the bottom panel set in the bottom frame, are divided along at least one division line, and accordingly, the support holes are also divided into upper and lower halves respectively having the upper and lower inner peripheral parts which are covered with semicircular elastic protecting members having an inner diameter substantially equal to the outer diameter of the support tube. The elastic member is preferably made of rubber.

These elastic protecting members define circular holes which can receive and hold therein the support tubes when the upper and lower halves of the support holes are mated with each other, and effects damping action and non-slip action. It is noted that the number of divisions of each partition panel in the vertical direction is optional, that is, it may be two or more. That is, the number of the division lines may be one or more as shown in FIG. 1.

The method of storing rolled articles in the above-mentioned container comprises the steps of: horizontally laying the bottom panel in the bottom frame, setting the left and right side panels on the bottom panel in the bottom frame so that they stand upright to the bottom panel, inserting the lower parts of the front and rear partition panels in vertical grooves formed in the side panels along side edges thereof, and sliding down the lower parts of the partition panels through the vertical grooves until the lower parts of the partition panels reach the bottom panel, fitting support tubes, that is, the spool of the rolled articles, on the semicircular lower halves of the support holes, formed in the upper edges of the lower parts of the partition panels, then inserting the upper parts of the partition panels in the vertical grooves of the side panels and sliding down them, and fastening the side panels and the partition panels together by using fixtures provided to the upper parts of the partition panels. Thus, the roller articles are suspended within the inside space of the container between the front and rear partition panels, being supported by the support tubes. In such a case that the spool of each rolled article is separatable from the support tube, the support tube is inserted through the hollow part of the spool as mentioned above.

In a first preferable embodiment of the present invention, the peripheral edge parts and the edges parts, along the dividing lines, of the front and rear partition panels of the above-mentioned container for storing and transporting rolled articles, are protected by U-like cross-sectional shape plastic protecting members.

With this arrangement in which the edges parts of the partition panels are protected by the plastic protecting members, the slidability and the durability thereof can be enhanced, and accordingly, no burring occurs even after using several times. It is noted that the plastic protecting members are preferably made of ABS resin.

In a second preferable embodiment of the present invention, the above-mentioned side panels of the container for storing and transporting rolled article are reinforced at their upper and lower end parts with U-like cross-sectional shape metal reinforcing members, and are provided at their left and right edge parts with metal reinforcing members formed therein with the vertical grooves in which the partition panels are held.

With this arrangement in which the upper and lower end parts, and the left and right edge parts of the side panels are reinforced by the metal reinforcing members, the container has a strength with which the container bears against a heavy load caused by multi-stacking of containers. Further, the partition panels are inserted in the vertical grooves of the reinforcing members at the left and right edge parts of the side panels, and accordingly the partition panels are held upright. It is noted that these reinforcing members are preferably made of steel.

In a third preferable embodiment of the present invention, the upper or middle parts of the partition panels of the container for storing and transporting roller articles, are incorporated with fixtures for fastening the partition panels and the side panels together.

With this arrangement, the fixtures can prevent the space between the side panels for holding the partition panels by means of the vertical grooves, from being widened, thereby it is possible to prevent the partition panels from coming off out of the vertical grooves. The fixtures have any of structures which can fasten the side panels to the partition panels, firmly together.

In a fourth preferable embodiment of the present invention, the bottom frame of the container for storing and transporting roller articles, which is preferably fixed on a pallet, is made of metal angle members, and is formed therein with grooves for holding the side panels upright.

With this arrangement in which the bottom frame is made of metal, and formed at its a pair of opposed sides with the grooves for holding the side panels upright, the partition panels are supported at another pair of opposes sides with no grooves, and the bottom panel is horizontally set in the bottom frame. It is noted that pin grooves through which the side panels are coupled to the bottom frame by pins are formed in the bottom frame and the side panels at positions where they overlap with each other.

In a fifth embodiment of the present invention, the top cover of the container for storing and transporting rolled articles, is formed of a plywood board surrounded at its periphery with a frame formed of metal angle members, and attached at its four corners of the rear surface with corner fittings, and is water-proofed.

With this arrangement, the metal angle members and the corner fittings bear against load caused by multi-stacking of containers or the like, so as to protect the top cover, and further, it is protected from rain water or the like during transportation since it is water-proofed. It is noted that the metal angle members of the frame are preferably made of steel.

The present invention will be hereinbelow detailed in a preferred embodiment form with reference to the drawings in which:

BRIEF DESCRIPTION OF THE INVENTION

DESCRIPTION OF THE PREFERRED EMBODIMENTS

Explanation will be hereinbelow detailed of a preferred embodiment of the present invention with reference to the drawings.

Figure 1:
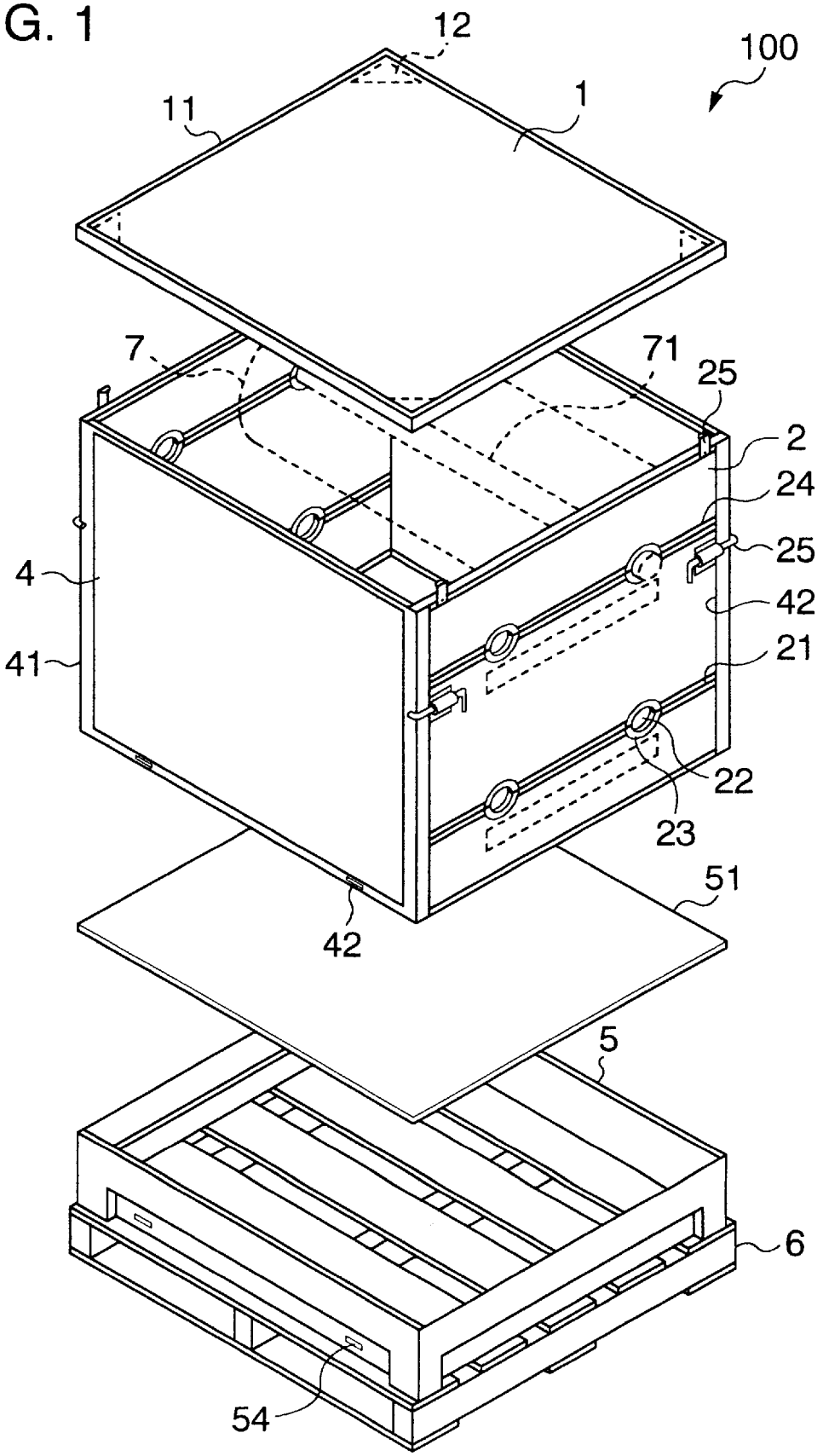
FIG. 1 is an exploded perspective view illustrating a container for storing and transporting rolled articles in an embodiment form of the present invention.

Referring to FIG. 1 which is a perspective view illustrating a container for storing and transporting rolled articles, which is generally denoted by reference numeral 100, the container 100 is composed of a top cover 1, front and rear partition panels 2, left and right side panels 4, a bottom frame 5 set on a pallet 6, and a bottom panel 51 set in the bottom frame 5. A steel angle frame 11 is provided around the outer periphery of the top cover 1, and triangular corner fittings 12 are attached at four corners of the rear surface of the top cover 1. Each of the partition panels 2 are vertically divided into three parts along division lines 21, that is, an upper part, a middle part and a lower part, and is formed therein with support holes 22 which are aligned with the division lines 21. Each of the support holes 22 is protected at its inner periphery by a rubber protector 23. Further, each partition panel 2 is protected at its outer peripheral edge part, and at the divided edge part by ABS resin protectors 24. The upper part or the intermediate part of each of the partition panels 2 is provided with fixtures 25. Each of the side panels 4 is provided, along its outer periphery, with a steel reinforcing member 41 incorporated therein with vertical grooves 42.

The thus formed container 100 is stored therein with rolled articles 7 each having a spool or a support tube, which is not essential in the present invention.

The container 100 has a box-like shape composed of the top cover 1, the bottom panel 51 set in the bottom frame 51 fixed to the pallet 6, and the partition panels 2, 2 and the side panels 4, 4, having a length, a width and a height which are all about 1 m. This container 10 can store therein four rolled articles 7 having a length less than 1 m. The support tube 71 of each of the rolled articles is slightly longer than the distance of the space between the partition panels 2, 2. If the length of the support tube 71 is shorter than the distance of the space between the partition panels 2, 2, a ring-like damper is inserted between each end face of the roller article 7 and the associated partition panel 2. The main body of the container is mainly made of plywood, and the components thereof can be separated from one another so that they can be folded and stored within the bottom frame 3. The pallet 6 may be made of wood or resin.

In the container 100, the front and rear partition panels 2, 2 held by the left and right side panels 4, 4 and the bottom panel 51 in the bottom frame 5, are divided in the vertical direction, along the division lines 21, and are formed therein with the opposed support holes 22, being aligned with the division lines 21. In this embodiment, the number of pairs of the opposed support holes 22 is four.

It is noted that rectangular reinforcing strips (indicated by the dotted line in FIG. 1) having an arbitrary thickness may be laid on the upper end edges of divided parts of the partition panels 2, 2 along the division lines 21, bridging between the support holes 21 in order to enhance the shock-proof strength during transportation, storage or handling thereof.

Figure 2A:
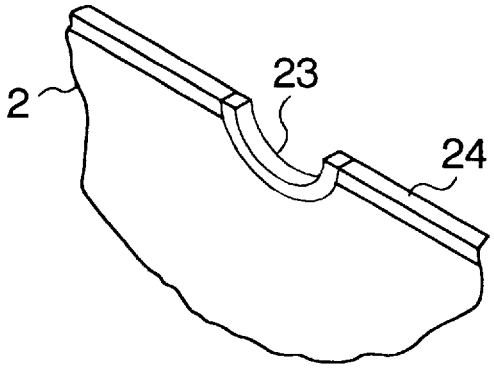
FIG. 2A is a perspective view illustrating a divided edge part of the container shown in FIG. 1.

The support holes 21 are also divided into upper and lower halves which are covered at their inner periphery with semicircular rubber protectors 23 having an inner diameter substantially equal to the outer diameter of the support tube 7. These protectors 23 define circular holes which can receive therein the support tubes 71 when the vertically divided parts of the partition panels 21 are joined together, and effect damping action and nonslipping action for the support tubes 71. FIG. 2A is a perspective view which shows the rubber protector 23.

Figure 2B:
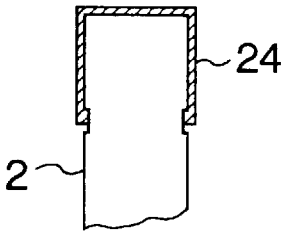
FIG. 2B is a partly sectioned view illustrating an upper edge part of a partition panels of the container shown in FIG. 1.

FIG. 2B is a sectional view which shows the peripheral edge part and the division line part of the partition panel 2. These parts of the partition panel are protected by protectors 24 made of ABS resin and formed in an U-like cross-sectional shape. With this arrangement, the slip ability and the durability of the partition panel 2 can be enhanced, causing no burring even after using several times.

Figure 2C:
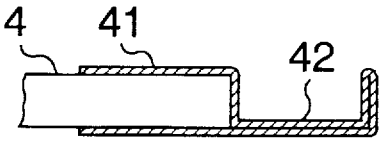
FIG. 2C is a partly sectioned view illustrating a side edge part of a side panel of the container shown in FIG. 1.

FIG. 2C is a sectional view which shows the peripheral edge part of the side panel 4. The peripheral edge part of the side panel 4 is reinforced by a steel reinforcing member 41 having a U-like cross-sectional shape so as to exhibit a strength which can bear against a load caused by multi-stacking of containers 100. It is noted that the reinforcing members 4 provided to the left and right edge parts of the side panel 4 incorporate vertical grooves 42 in which the partition panels 2 are fitted so as to be held upright.

The top cover 1 is made of plywood, and is reinforced at its outer periphery by the steel angle member frame 11 while the corner fittings 12 are attached at the four corners of the rear surface thereof, and is subjected to water-proof treatment. The steel angle member frame 11 and the corner fittings 12 receive downward load in the case of multi-stacking of the containers 10 and so forth so as to protect the top cover, and the water-proof treatment can protect the top cover from rain water or the like during transportation.

The steel bottom frame 5 may be made of steel, having four sides among which two opposed sides are formed thereon with vertical channels in which the side panels 4 are held upright. Further, the partition panels 2 are held at their lower end parts on the bottom panel 51 at other two opposed sides, having no channels, within the bottom frame 5. The overlapping parts of the bottom frame 5 and the side panels 4 are formed therein pin grooves 42, 54 for coupling the side panels 4 to the bottom frame 5.

When the rolled articles 7 are stored in the container 100 for storing and transporting the roller articles 7 in this embodiment constituted as mentioned above, at first, the bottom panel 51 is horizontally set in the bottom frame 5, then the left and right side panels 4 are set upright on the bottom panel 51, and the lower parts of the front and rear partition panels 2, 2 are fitted and slid down in the vertical grooves provided along the left and right edges of the side panels 4 until they reach the bottom panel 51. Thereafter, the support tubes 71 of the rolled articles 7 are set at their opposite ends on the lower halves of the support holes 22 having a semicircular shape at the upper edges of the lower parts of the partition panels 2, 2, then, the upper parts of the partition panels 2, 2 are fitted in the vertical grooves of the side panels 4, 4, and the side panels 4 and the partition panels 2 are fastened together by the fixtures 25 provided to the upper parts of the partition panels 11. Thus, the roller articles 7 supported by the support tubes 71 are suspended between the front and rear partition panels 2, 2 within the container 100. The removal of the roller articles 7 form the container 100 can be made by carrying out the above-mentioned steps in the reverse order.

As mentioned above, in the container for storing and transporting rolled articles, according to the present invention, the rolled articles are held in such a condition that they can be prevented from being made into contact with one another or with the interior of the container, and accordingly, the rolled articles can be safely protected against chafing or the like even though individual packing therefor is eliminated during storage thereof. Thereby it is possible to save labor and materials for the primary packing.

When the rolled articles are stored, the rolled articles can be simply suspended between the partition panels since the partition panels are divided in the vertical directions, and further, the partition panels are slippery since they are protected at their outer peripheral parts with the plastic protectors, and are durable against several repeated uses with no burring.

The container incorporates the top cover, the side panels, the metal bottom frame with the corner fittings and the reinforcements, and accordingly, it can bear against large external force so that they can be stacked one upon another. Thereby, it is possible to save their storage space, and to enhance the efficiency of transportation.

Further, the container is foldable so as to be repeatedly usable, and accorordingly, the storage thereof during no use, the returning thereof for reuse and so forth can be efficiently carried out, and further, since no individual packing for rolled articles is required, substantially no quantity of waste of packing material is caused.

Although the present invention has been explained in the form of the preferred embodiment in which the rolled articles are stored and transported, the present invention should not be limited to this embodiment. The present invention can be applied for transportation of another articles having similar support tubes.

What is claimed is:

1. A container for storing articles carried by rod-like members, comprising:

a bottom frame;

a bottom panel set horizontally in said bottom frame;

side panels removably supported and held upright on said bottom panel at two opposed sides of said bottom frame;

partition panels removably supported and held upright on said bottom panel at other two sides of said bottom frame, orthogonal to the afore-mentioned two opposed sides;

a cover member laid on the top end parts of said side panels and said partition panels held upright on the bottom frame;

wherein each of said partition panels is vertically divided into at least two parts at meeting edges which are along a along division line, and support holes are formed in the meeting edges for holding end parts of said rod-like members, along said division lines.

2. A container as set forth in claim 1, wherein parts of the partition panels along the peripheral edges and the division lines, are provided with U-like cross-sectional shape protectors.

3. A container as set forth in claim 2, wherein upper and lower end parts of said side panels are provided with U-like cross-sectional shape metal reinforcing members, and opposite side edge parts of said side panels are provided with lateral metal reinforcing members formed therein with grooves for holding side edge parts of said partition panels.

4. A container as set forth in claim 1, wherein said partition panels are provided with fasteners for coupling them to said side panels.

5. A container as set forth in claim 1, wherein said bottom frame is made of steel and having four sides of which two opposite sides have vertical channels in which said side panels are held upright, and of which other two sides hold therealong said partition panels upright.

6. A container as set forth in claim 1, wherein pin grooves for fixing and holding said side panels to the bottom frame are formed in overlapping parts of said side panels and said bottom frames.

7. A container as set forth in claim 1, wherein said cover member is reinforced at their periphery with metal angle members, and is provided at four corners on the rear surface of said cover member with reinforcing fittings for bearing against load caused by multi-stacking of containers.

* * * * *